US010021506B2

(12) United States Patent
Johnson et al.

(10) Patent No.: US 10,021,506 B2
(45) Date of Patent: Jul. 10, 2018

(54) ADJUSTING THE BEAM PATTERN OF A SPEAKER ARRAY BASED ON THE LOCATION OF ONE OR MORE LISTENERS

(71) Applicant: Apple Inc., Cupertino, CA (US)

(72) Inventors: Martin E. Johnson, Los Gatos, CA (US); Ronald N. Isaac, San Ramon, CA (US); Afrooz Family, Emerald Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/771,475

(22) PCT Filed: Mar. 4, 2014

(86) PCT No.: PCT/US2014/020433

§ 371 (c)(1),
(2) Date: Aug. 28, 2015

(87) PCT Pub. No.: WO2014/138134

PCT Pub. Date: Sep. 12, 2014

(65) Prior Publication Data

US 2016/0021481 A1 Jan. 21, 2016

Related U.S. Application Data

(60) Provisional application No. 61/773,078, filed on Mar. 5, 2013.

(51) Int. Cl.
*H04S 7/00* (2006.01)
*H04R 3/12* (2006.01)
(Continued)

(52) U.S. Cl.
CPC ..... *H04S 7/305* (2013.01); *H04R 1/403* (2013.01); *H04R 3/12* (2013.01); *H04R 5/04* (2013.01);
(Continued)

(58) Field of Classification Search
CPC .. H04R 2499/13; H04R 3/12; H04R 2203/12; H04S 7/302; H04S 2400/11; G10K 2210/305; G10H 2210/281
(Continued)

(56) References Cited

U.S. PATENT DOCUMENTS 5,732,143 A * 3/1998 Andrea ..... G10K 11/178 381/71.13
6,243,476 B1 6/2001 Garner
(Continued)

FOREIGN PATENT DOCUMENTS

JP 2006060610 3/2006
JP 2009206754 9/2009
WO WO2012/093345 A1 7/2012

OTHER PUBLICATIONS

PCT International Search Report and Written Opinion for PCT International Appln No. PCT/US2014/020433 filed on Mar. 4, 2014 (11 pages).
(Continued)

*Primary Examiner* — George C Monikang

(57) ABSTRACT

A directivity adjustment device that maintains a constant direct-to-reverberant ratio based on the detected location of a listener in relation to the speaker array is described. The directivity adjustment device may include a distance estimator, a directivity compensator, and an array processor. The distance estimator detects the distance between the speaker array and the listener. Based on this detected distance, the directivity compensator calculates a directivity index form a beam produced by the speaker array that maintains a predefined direct-to-reverberant sound energy ratio. The array processor receives the calculated directivity index and processes each channel of a piece of sound program content to produce a set of audio signals that drive
(Continued)

one or more of the transducers in the speaker array to generate a beam pattern with the calculated directivity index.

22 Claims, 7 Drawing Sheets

(51) Int. Cl.
*H04R 1/40* (2006.01)
*H04R 5/04* (2006.01)
*H04S 3/00* (2006.01)

(52) U.S. Cl.
CPC ..... *H04S 3/008* (2013.01); *H04S 7/303* (2013.01); *H04R 2201/401* (2013.01); *H04R 2201/403* (2013.01); *H04R 2203/12* (2013.01); *H04S 2400/01* (2013.01)

(58) Field of Classification Search
USPC ..... 381/92, 122, 77, 59, 66, 63–64
See application file for complete search history.

(56) References Cited

U.S. PATENT DOCUMENTS

| | | | | |
|---|---|---|---|---|
| 7,515,719 | B2 | 4/2009 | Hooley et al. | |
| 7,860,260 | B2 | 12/2010 | Kim et al. | |
| 8,130,968 | B2 | 3/2012 | Tamaru et al. | |
| 8,135,143 | B2 | 3/2012 | Ishibashi et al. | |
| 8,223,992 | B2 | 7/2012 | Suzuki et al. | |
| 2004/0114770 | A1* | 6/2004 | Pompei | H04R 5/02 381/77 |
| 2004/0208324 | A1 | 10/2004 | Cheung et al. | |
| 2008/0089522 | A1 | 4/2008 | Baba et al. | |
| 2008/0226084 | A1 | 9/2008 | Konagai et al. | |
| 2009/0117948 | A1* | 5/2009 | Buck | 455/570 |
| 2009/0129602 | A1 | 5/2009 | Konagai et al. | |
| 2009/0161880 | A1 | 6/2009 | Hooley et al. | |
| 2011/0058677 | A1 | 3/2011 | Choi et al. | |
| 2012/0020480 | A1 | 1/2012 | Visser et al. | |
| 2013/0151244 | A1* | 6/2013 | Chen | G10L 25/69 704/205 |
| 2013/0223658 | A1 | 8/2013 | Betlehem et al. | |
| 2015/0223002 | A1 | 8/2015 | Mehta et al. | |
| 2015/0271620 | A1 | 9/2015 | Lando et al. | |

OTHER PUBLICATIONS

PCT International Preliminary Report on Patentability for PCT International Appin No. PCT/US2014/020433 dated Sep. 17, 2015 (8 pages).

Australian Patent Examination Report (dated May 20, 2016), Application No. 2014225904, Date Filed: Mar. 4, 2014, 3 pages.

Japanese Office Action with English Language Translation, dated Sep. 5, 2016, Japanese Application No. 2015-561566.

European Office Action, dated Oct. 10, 2016, European Application No. 14710772.6.

Korean Office Action with English Language Translation, dated Jan. 3, 2017, Korean Application No. 10-2015-7024190.

Australian Examination Report, dated Dec. 15, 2016, Australian Application No. 2014225904.

Hioka, Yusuke, et al., "Evaluating Estimation of Direct-to-Reverberation Energy Ratio using D/R Spatial Correlation Matrix Model", *Proceedings of 20th International Congress on Acoustics*, (Aug. 23-27, 2010), 1-7.

European Office Action, dated Jun. 20, 2017, European Application No. 14710772.6.

Larsen, Erik, et al., "On the minimum audible difference in direct-to-reverberant energy ratio", *The Journal of the Acoustical Society of America*, vol. 124, No. 1, (Jul. 1, 2008), 450-461.

Van Der Werff, Johan, et al., "Electronically Controlled Loudspeaker Arrays Without Side Lobes", *Audio Engineering Society Convention Paper Presented at the 110th Convention*, (May 12, 2001), 7 pages.

Korean Office Action with English Language Translation, dated Nov. 13, 2017, Korean Application No. 10-2015-7024190.

* cited by examiner

ADJUSTING THE BEAM PATTERN OF A SPEAKER ARRAY BASED ON THE LOCATION OF ONE OR MORE LISTENERS

RELATED MATTERS

This application is a U.S. National Phase Application under 35 U.S.C. § 371 of International Application No. PCT/US2014/020433, filed Mar. 4, 2014, which claims the benefit of the earlier filing date of U.S. provisional application No. 61/773,078, filed Mar. 5, 2013, and this application hereby incorporates herein by reference these previous patent applications.

FIELD

An audio device detects the distance of a listener from a speaker array and adjusts the directivity index of a beam pattern output by the speaker array to maintain a constant direct-to-reverberant sound energy ratio. Other embodiments are also described.

BACKGROUND

Speaker arrays may be variably driven to form numerous different beam patterns. The generated beam patterns can be controlled and altered to change the direction and region over which sound is radiated. Using this property of speaker arrays allows some acoustic parameters to be controlled. One such parameter is the direct-to-reverberant acoustic energy ratio. This ratio describes how much sound a listener receives directly from a speaker array compared to how much sound reaches the listener via reflections off walls and other reflecting objects in a room. For example, if a beam pattern generated by a speaker array is narrow and pointed at a listener, the direct-to-reverberant ratio will be large since the listener is receiving a large amount of direct energy and a comparatively smaller amount of reflected energy. Alternatively, if a beam pattern generated by the speaker array is wide, the direct-to-reverberant ratio is smaller as the listener is receiving comparatively more sound reflected off surfaces and objects.

SUMMARY

Loudspeaker arrays may emit both direct sound energy and an indirect or reverberant sound energy at a listener in a room or listening area. The direct sound energy is received directly from transducers in the speaker array while reverberant sound energy reflects off walls or surfaces in the room before arriving at the listener. As the listener moves closer to the speaker array, the direct-to-reverberant sound energy level increases as the propagation distance for the direct sounds is noticeably decreased while the propagation distance for the reverberant sounds is relatively unchanged or only slightly increased.

An embodiment of the invention is a directivity adjustment device that maintains a constant direct-to-reverberant ratio based on the detected location of the listener in relation to the speaker array. The directivity adjustment device may include a distance estimator, a directivity compensator, and an array processor. The distance estimator detects the distance between the speaker array and the listener. For example, the distance estimator may use (1) a user input device; (2) a microphone; (3) infrared sensors; and/or (4) a camera to determine the distance between the speaker array and the listener. Based on this detected distance, the directivity compensator calculates a directivity index from a beam produced by the speaker array that maintains a predefined direct-to-reverberant sound energy ratio. The direct-to-reverberant ratio may be preset by a manufacturer or designer of the directivity adjustment device and may be variable based on the content of sound program content played. The array processor receives the calculated directivity index and processes each channel of a piece of sound program content to produce a set of audio signals that drive one or more of the transducers in the speaker array to generate a beam pattern with the calculated directivity index. By maintaining a constant direct-to-reverberant directivity ratio, the directivity adjustment device improves the consistency and quality of sound perceived by the listener.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
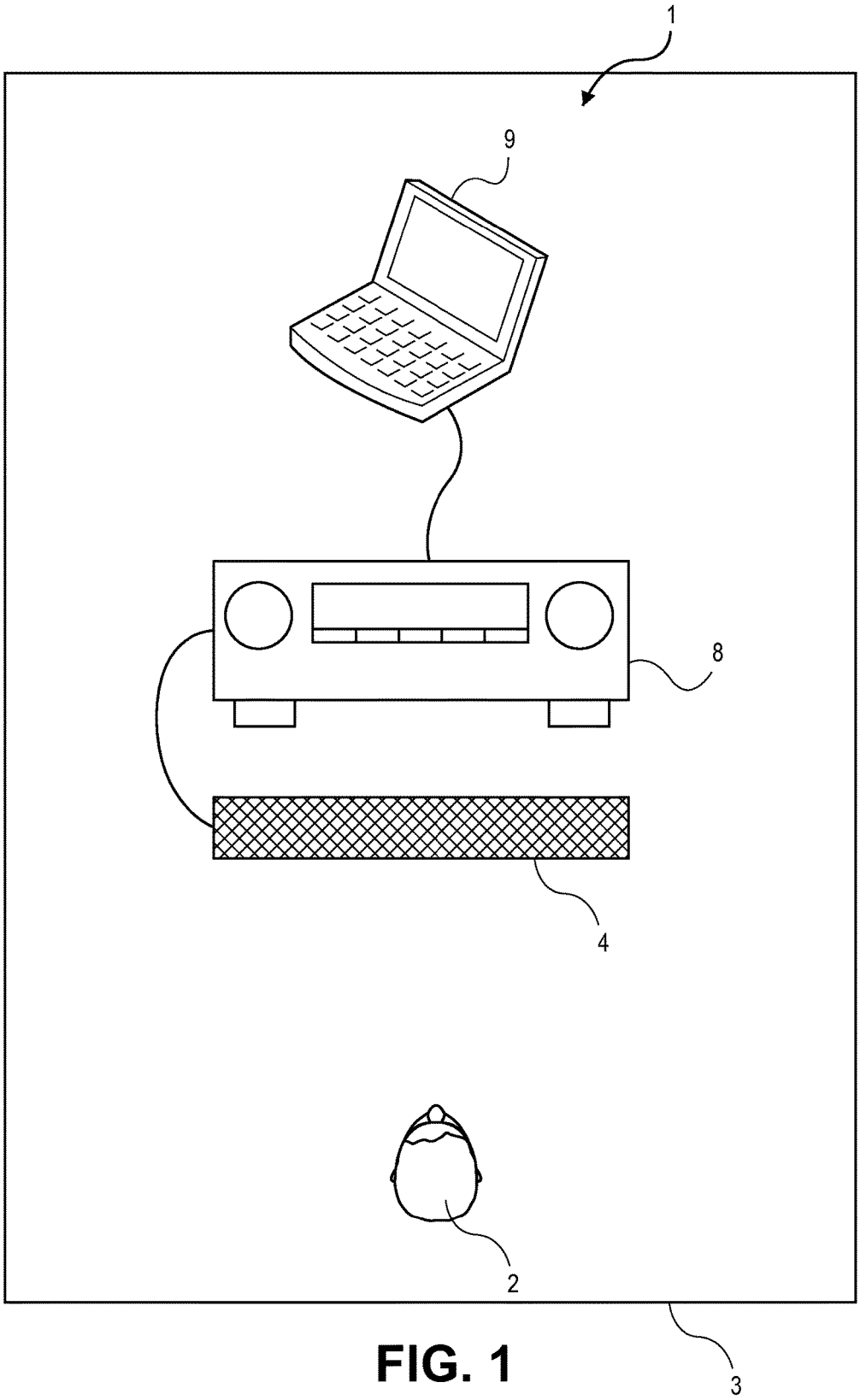
FIG. 1 shows a beam adjustment system that adjusts the width of a generated sound pattern based on the location of one or more listeners in a room or listening area according to one embodiment.

FIG. 1 shows a beam adjustment system 1 that adjusts the width of a generated sound pattern emitted by a speaker array 4 based on the location of one or more listeners 2 in a room or listening area 3. Each element of the beam adjustment system 1 will be described by way of example below.

Figure 2A:
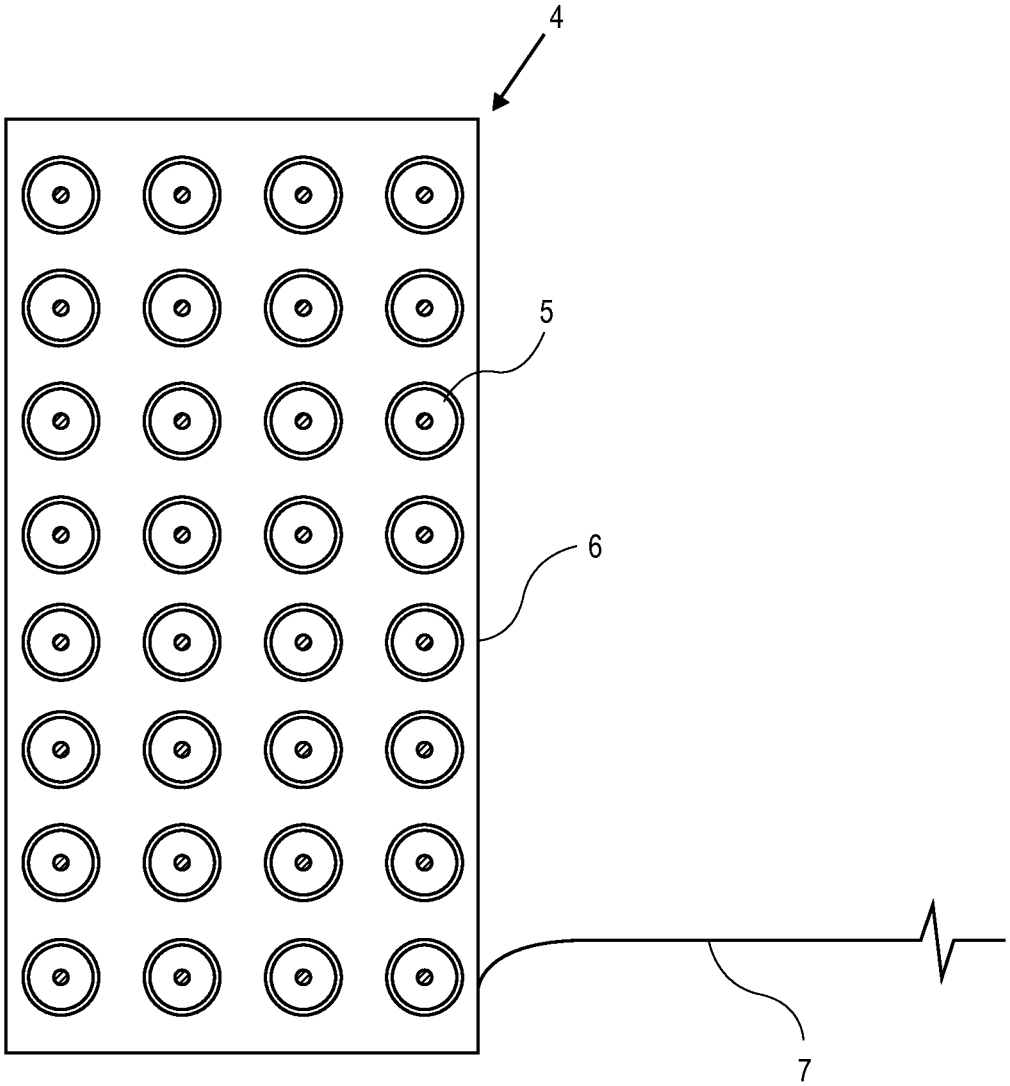
FIG. 2A shows one loudspeaker array with multiple transducers housed in a single cabinet according to one embodiment.
Figure 2B:
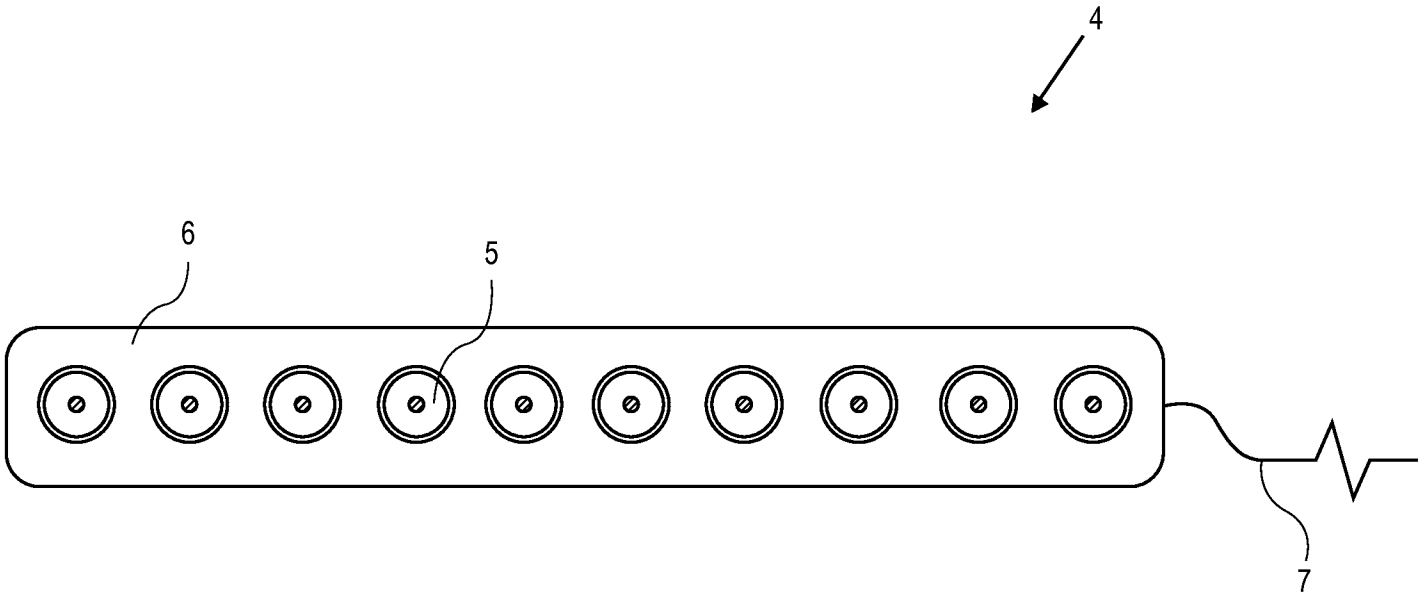
FIG. 2B shows another loudspeaker array with multiple transducers housed in a single cabinet according to another embodiment.

The beam adjustment system 1 includes one or more speaker arrays 4 for outputting sound into the room or listening area 3. FIG. 2A shows one speaker array 4 with multiple transducers 5 housed in a single cabinet 6. In this example, the speaker array 4 has 32 distinct transducers 5 evenly aligned in eight rows and four columns within the cabinet 5. In other embodiments, different numbers of transducers 5 may be used with uniform or non-uniform spacing. For instance, as shown in FIG. 2B, 10 transducers 5 may be aligned in a single row in the cabinet 6 to form a sound-bar style speaker array 4. Although shown as aligned is a flat plane or straight line, the transducers 5 may be aligned in a curved fashion along an arc.

The transducers 5 may be any combination of full-range drivers, mid-range drivers, subwoofers, woofers, and tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 5 magnetic system interact, generating a mechanical force that causes the coil (and thus, the attached cone) to move back and forth, thereby reproducing sound under the control of the applied electrical audio signal coming from a source (e.g., a signal processor, a computer, and an audio receiver). Although described herein as having multiple transducers 5 housed in a single cabinet 6, in other embodiments the speaker arrays 4 may include a single transducer 5 housed in the cabinet 6. In these embodiments, the speaker array 4 is a standalone loudspeaker.

Each transducer 5 may be individually and separately driven to produce sound in response to separate and discrete audio signals. By allowing the transducers 5 in the speaker arrays 4 to be individually and separately driven according to different parameters and settings (including delays and energy levels), the speaker arrays 4 may produce numerous directivity patterns to simulate or better represent respective channels of sound program content played to the listener 2. For example, beam patterns of different widths and directivities may be emitted by the speaker arrays 4 based on the location of the listener 2 in relation to the speaker arrays 4.

As shown in FIGS. 2A and 2B, the speaker arrays 4 may include wires or conduit 7 for connecting to a directivity adjustment device 8. For example, each speaker array 4 may include two wiring points and the directivity adjustment device 8 may include complementary wiring points. The wiring points may be binding posts or spring clips on the back of the speaker arrays 4 and the directivity adjustment device 8, respectively. The wires 7 are separately wrapped around or are otherwise coupled to respective wiring points to electrically couple the speaker arrays 4 to the directivity adjustment device 8.

In other embodiments, the speaker arrays 4 are coupled to the directivity adjustment device 8 using wireless protocols such that the arrays 4 and the directivity adjustment device 8 are not physically joined but maintain a radio-frequency connection. For example, the speaker arrays 4 may include a WiFi receiver for receiving audio signals from a corresponding WiFi transmitter in the directivity adjustment device 8. In some embodiments, the speaker arrays 4 may include integrated amplifiers for driving the transducers 5 using the wireless audio signals received from the directivity adjustment device 8.

Although shown as including two speaker arrays 4, the audio system 1 may include any number of speaker arrays 4 that are coupled to the directivity adjustment device 8 through wireless or wired connections. For example, the audio system 1 may include six speaker arrays 4 that represent a front left channel, a front center channel, a front right channel, a rear right surround channel, a rear left surround channel, and a low frequency channel (e.g., a subwoofer). Hereinafter, the beam adjustment system 1 will be described as including a single speaker array 4. However, as described above, it is understood that the system 1 may include multiple speaker arrays 4.

Figure 3:
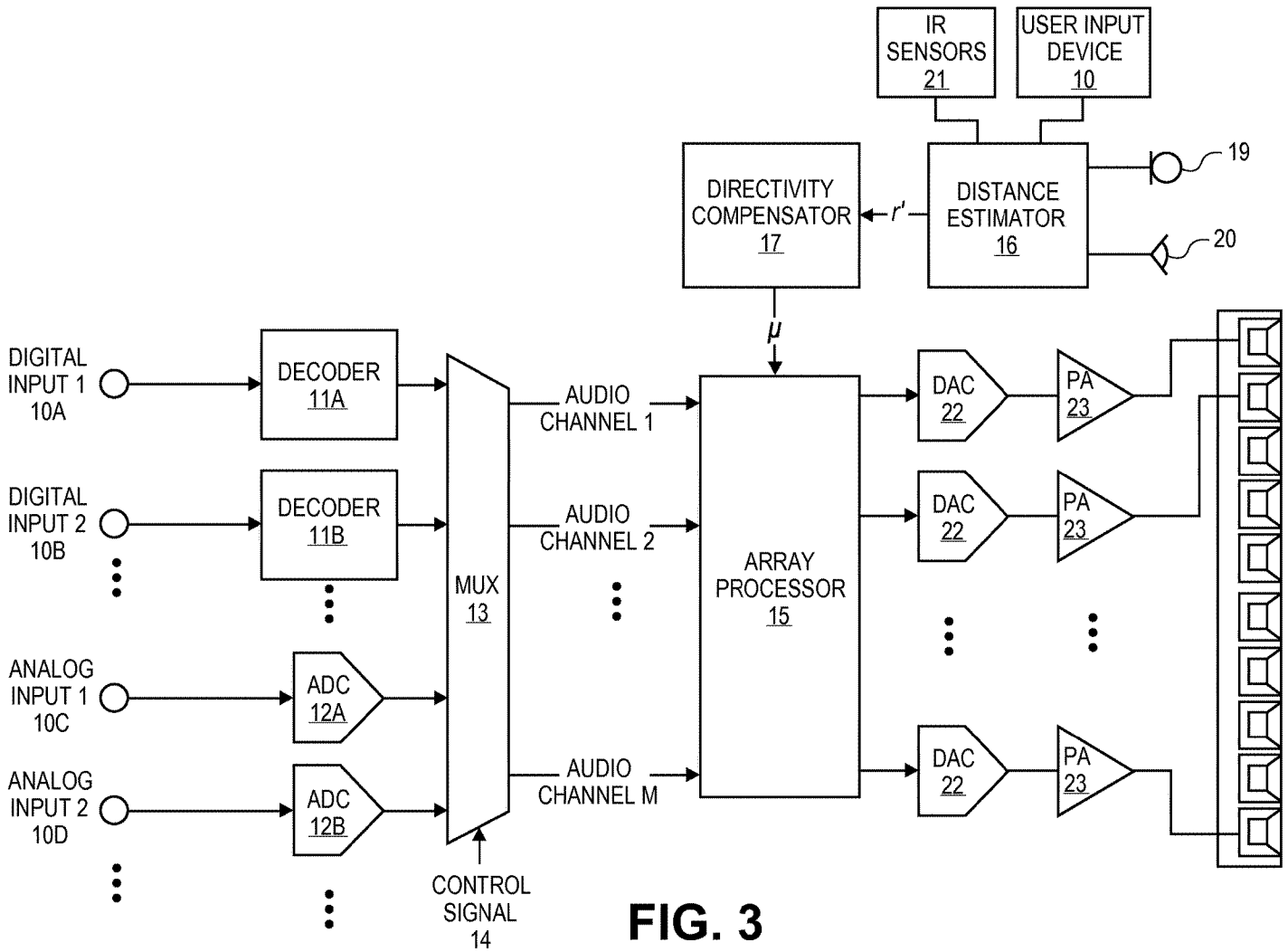
FIG. 3 shows a functional unit block diagram and some constituent hardware components of a directivity adjustment device according to one embodiment.

FIG. 3 shows a functional unit block diagram and some constituent hardware components of the directivity adjustment device 8 according to one embodiment. The components shown in FIG. 3 are representative of elements included in the directivity adjustment device 8 and should not be construed as precluding other components. Each element of FIG. 3 will be described by way of example below.

The directivity adjustment device 8 may include multiple inputs 10 for receiving one or more channels of sound program content using electrical, radio, or optical signals from one or more external audio sources 9. The inputs 10 may be a set of digital inputs 10A and 10B and analog inputs 10C and 10D, including a set of physical connectors located on an exposed surface of the directivity adjustment device 8. For example, the inputs 10 may include a High-Definition Multimedia Interface (HDMI) input, an optical digital input (Toslink), a coaxial digital input, and a phono input. In one embodiment, the directivity adjustment device 8 receives audio signals through a wireless connection with an external audio source 9. In this embodiment, the inputs 10 include a wireless adapter for communicating with the external audio source 9 using wireless protocols. For example, the wireless adapter may be capable of communicating using Bluetooth, IEEE 802.11x, cellular Global System for Mobile Communications (GSM), cellular Code division multiple access (CDMA), or Long Term Evolution (LTE).

As shown in FIG. 1, the external audio source 9 may include a laptop computer. In other embodiments, the external audio source 9 may be any device capable of transmitting one or more channels of sound program content to the directivity adjustment device 8 over a wireless or wired connection. For example, the external audio source 9 may include a desktop computer, a portable communications device (e.g., a mobile phone or tablet computer), a streaming Internet music server, a digital-video-disc player, a Blu-ray Disc™ player, a compact-disc player, or any other similar audio output device.

In one embodiment, the external audio source 9 and the directivity adjustment device 8 are integrated in one indivisible unit. In this embodiment, the loudspeaker arrays 4 may also be integrated into the same unit. For example, the external audio source 9 and the directivity adjustment device 8 may be in one computing unit with loudspeaker arrays 4 integrated in left and right sides of the unit.

Returning to the directivity adjustment device 8, general signal flow from the inputs 10 will now be described. Looking first at the digital inputs 10A and 10B, upon receiving a digital audio signal through the input 10A and/or 10B, the directivity adjustment device 8 uses a decoder 11A and/or 11B to decode the electrical, optical, or radio signals into a set of audio channels representing sound program content. For example, the decoder 11A may receive a single signal containing six audio channels (e.g., a 5.1 signal) and decode the signal into six audio channels. The decoder 11A may be capable of decoding an audio signal encoded using any codec or technique, including Advanced Audio Coding (AAC), MPEG Audio Layer II, MPEG Audio Layer III, and Free Lossless Audio Codec (FLAC).

Turning to the analog inputs 10C and 10D, each analog signal received by analog inputs 10C and 10D represents a single audio channel of the sound program content. Accordingly, multiple analog inputs 10C and 10D may be needed to receive each channel of a piece of sound program content. The audio channels may be digitized by respective analog-to-digital converters 12A and 12B to form digital audio channels.

The digital audio channels from each of the decoders 11A and 11B and the analog-to-digital converters 12A and 12B are output to the multiplexer 13. The multiplexer 13 selectively outputs a set of audio channels based on a control signal 14. The control signal 14 may be received from a control circuit or processor in the directivity adjustment device 8 or from an external device. For example, a control circuit controlling a mode of operation of the directivity adjustment device 8 may output the control signal 14 to the multiplexer 13 for selectively outputting a set of digital audio channels.

The multiplexer 13 feeds the selected digital audio channels to an array processor 15. The channels output by the multiplexer 13 are processed by the array processor 15 to produce a set of processed audio channels. The processing may operate in both the time and frequency domains using transforms such as the Fast Fourier Transform (FFT). The array processor 15 may be a special purpose processor such as application-specific integrated circuit (ASICs), a general purpose microprocessor, a field-programmable gate array (FPGA), a digital signal controller, or a set of hardware logic structures (e.g., filters, arithmetic logic units, and dedicated state machines). The array processor 15 generates a set of signals for driving the transducers 5 in the speaker array 4 based on inputs from a distance estimator 16 and/or a directivity compensator 17.

Figure 4A:
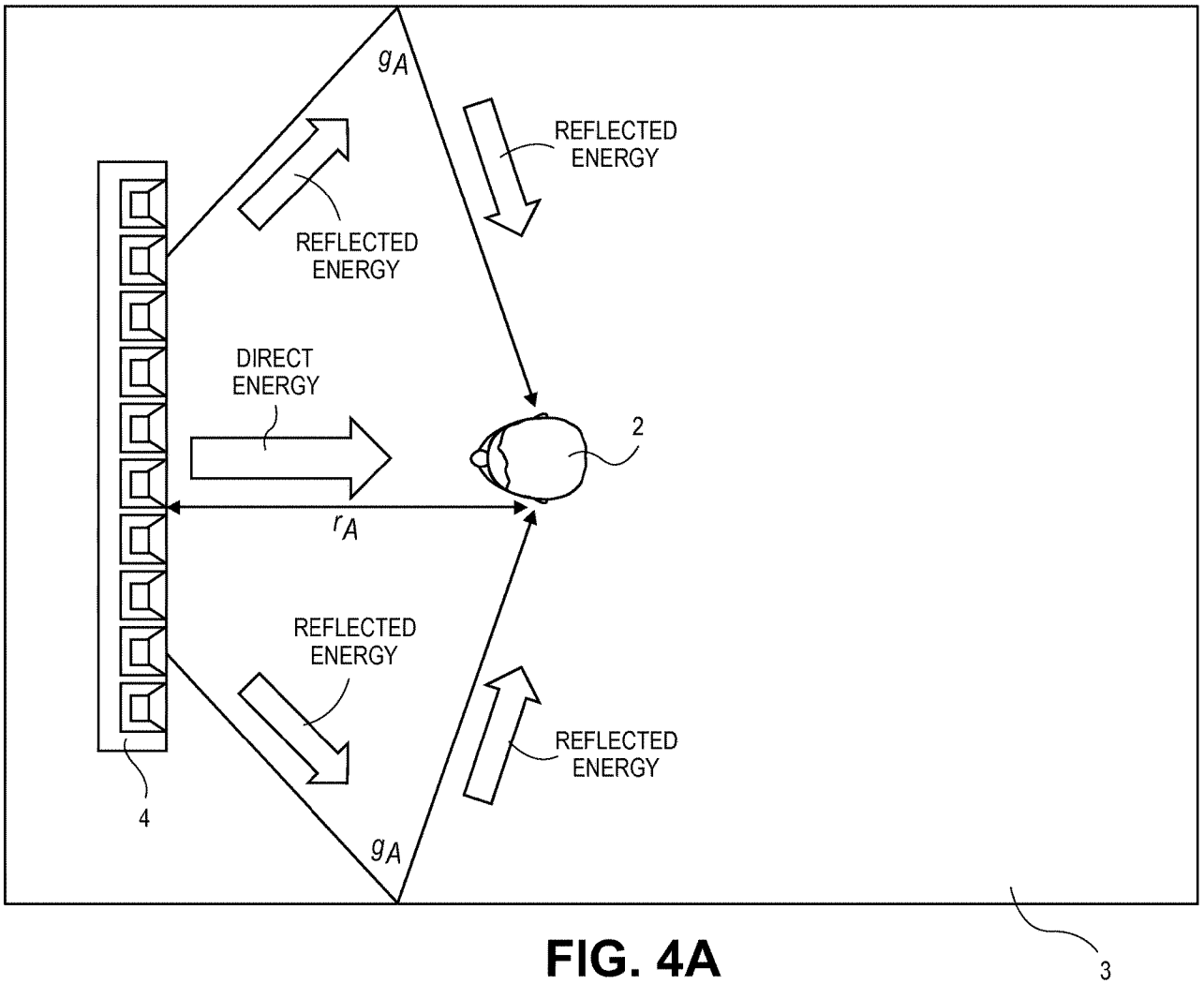
FIGS. 4A and 4B shows the listener located at various distances from the loudspeaker array.

The distance estimator 16 determines the distance of one or more human listeners 2 from the speaker array 4. FIG. 4A shows the listener 2 located a distance $r_A$ away from a speaker array 4 in the room 3. The distance estimator 16 determines the distance $r_A$ as the listener 2 moves around the room 3 and while sound is being emitted by the speaker arrays 4. Although described in relation to a single listener, the distance estimator 16 may determine the distance $r_A$ of multiple listeners 2 in the room 3.

The distance estimator 16 may use any device or algorithm for determining the distance r. In one embodiment, a user input device 18 is coupled to the distance estimator 16 for assisting in determining the distance r. The user input device 18 allows the listener 2 to periodically enter the distance r he/she is from the speaker array 4. For example, while watching a movie the listener 2 may initially be seated on a couch six feet from the speaker array 4. The listener 2 may enter this distance of six feet into the distance estimator 16 using the user input device 18. Midway through the movie, the listener 2 may decide to move to a table ten feet from the speaker array 4. Based on this movement, the listener 2 may enter this new distance $r_A$ into the distance estimator 16 using the user input device 18. The user input device 18 may be a wired or wireless keyboard, a mobile device, or any other similar device that allows the listener 2 to enter a distance into the distance estimator 16. In one embodiment, the entered value is a non-numeric or a relative value. For example, the listener 2 may indicate that they are far from or close to the speaker array 4 without indicating a specific distance.

In another embodiment, a microphone 19 may be coupled to the distance estimator 16 for assisting in determining the distance r. In this embodiment, the microphone 19 is located with the listener 2 or proximate to the listener 2. The directivity adjustment device 8 drives the speaker arrays 4 to emit a set of test sounds that are sensed by the microphone 19 and fed to the distance estimator 16 for processing. The distance estimator 16 determines the propagation delay of the test sounds as they travel from the speaker array 4 to the microphone 19 based on the sensed sounds. The propagation delay may thereafter be used to determine the distance $r_A$ from the speaker array 4 to the listener 2.

The microphone 19 may be coupled to the distance estimator 16 using a wired or wireless connection. In one embodiment, the microphone 19 is integrated in a mobile device (e.g., a mobile phone) and the sensed sounds are transmitted to the distance estimator 16 using one or more wireless protocols (e.g., Bluetooth and IEEE 802.11x). The microphone 19 may be any type of acoustic-to-electric transducer or sensor, including a MicroElectrical-Mechanical System (MEMS) microphone, a piezoelectric microphone, an electret condenser microphone, or a dynamic microphone. The microphone 19 may provide a range of polar patterns, such as cardioid, omnidirectional, and figure-eight. In one embodiment, the polar pattern of the microphone 19 may vary continuously over time. Although shown and described as a single microphone 19, in one embodiment, multiple microphones or microphone arrays may be used for detecting sounds in the room 3.

In another embodiment, a camera 20 may be coupled to the distance estimator 16 for assisting in determining the distance r. The camera 20 may be a video camera or still-image camera that is pointed in the same direction as the speaker array 4 into the room 3. The camera 20 records a video or set of still images of the area in front of the speaker array 4. Based on these recordings, the camera 20 alone or in conjunction with the distance estimator 16 tracks the face or other body parts of the listener 2. The distance estimator 16 may determine the distance $r_A$ from the speaker array 4 to the listener 2 based on this face/body tracking. In one embodiment, the camera 20 tracks features of the listener 2 periodically while the speaker array 4 outputs sound program content such that the distance $r_A$ may be updated and remains accurate. For example, the camera 20 may track the listener 2 continuously while a song is being played through the speaker array 4.

The camera 20 may be coupled to the distance estimator 16 using a wired or wireless connection. In one embodiment, the camera 20 is integrated in a mobile device (e.g., a mobile phone) and the recorded videos or still images are transmitted to the distance estimator 16 using one or more wireless protocols (e.g., Bluetooth and IEEE 802.11x). Although shown and described as a single camera 20, in one embodiment, multiple cameras may be used for face/body tracking.

In still another embodiment, one or more infrared (IR) sensors 21 are coupled to the distance estimator 16. The IR sensors 21 capture IR light radiating from objects in the area in front of the speaker array 4. Based on these sensed IR readings, the distance estimator 16 may determine the distance $r_A$ from the speaker array 4 to the listener 2. In one embodiment, the IR sensors 21 periodically operate while the speaker array 4 outputs sound such that the distance $r_A$ may be updated and remains accurate. For example, the IR sensors 21 may track the listener 2 continuously while a song is being played through the speaker array 4.

The infrared sensors 21 may be coupled to the distance estimator 16 using a wired or wireless connection. In one embodiment, the infrared sensors 21 are integrated in a mobile device (e.g., a mobile phone) and the sensed infrared light readings are transmitted to the distance estimator 16 using one or more wireless protocols (e.g., Bluetooth and IEEE 802.11x).

Although described above in relation to a single listener 2, in one embodiment the distance estimator 16 may determine the distance $r_A$ between multiple listeners 2 and the speaker array 4. In this embodiment, an average distance $r_A$ between the listeners 2 and the speaker array 4 is used to adjust sound emitted by the speaker array 4.

Figure 4B:
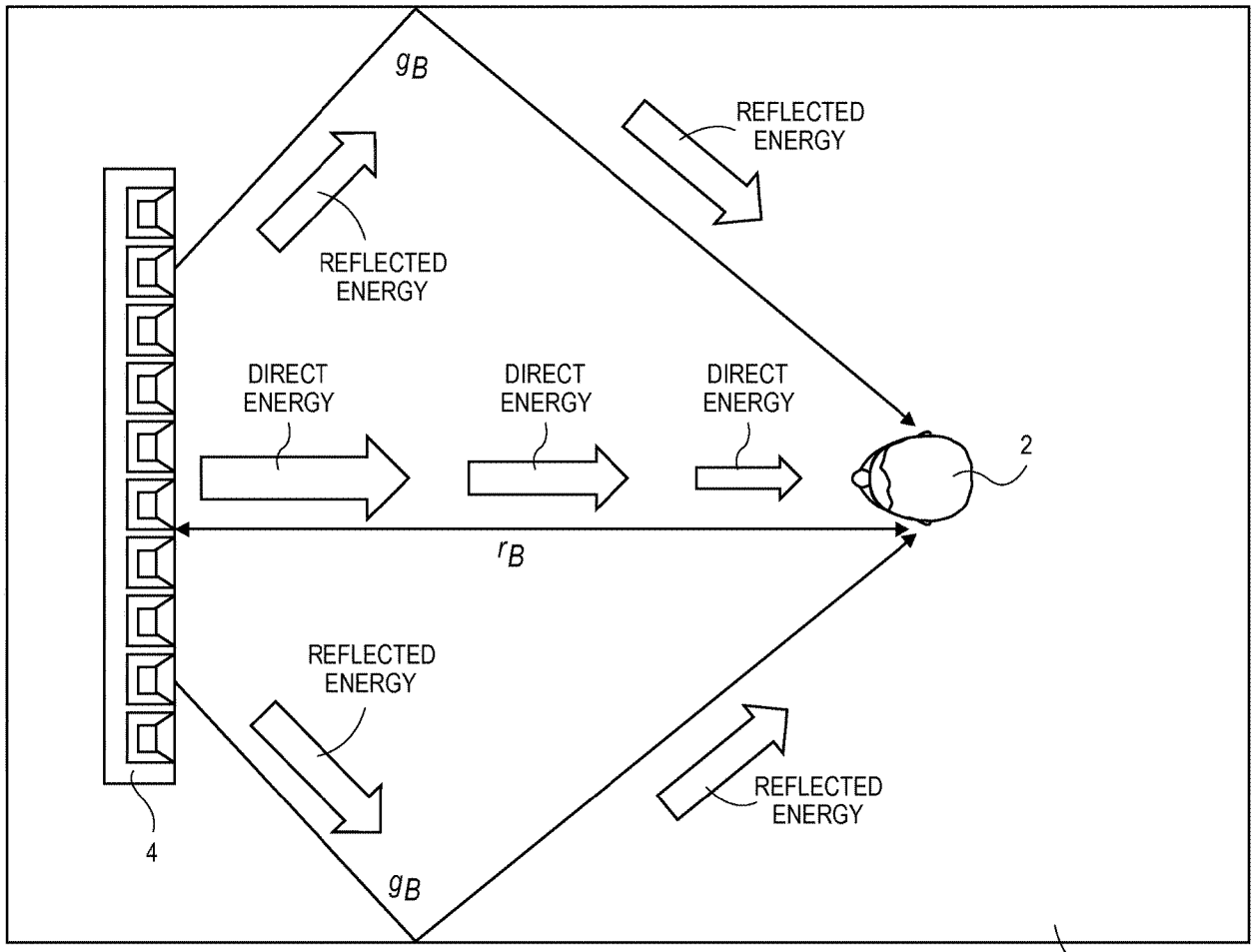

Using any combination of techniques described above, the distance estimator 16 calculates and feeds the distance r to the directivity compensator 17 for processing. The directivity compensator 17 computes a beam pattern that maintains a constant direct-to-reverberant sound ratio. FIGS. 4A and 4B demonstrate the changes to the direct-to-reverberant sound ratio relative to the listener 2 as the distance r increases.

In FIG. 4A, the listener 2 is a distance $r_A$ from the speaker array 4. In this example situation, the listener 2 is receiving a direct sound energy level $D_A$ from the speaker array 4 and an indirect or reverberant sound energy level $R_A$ from the speaker array 4 after the original sound has reflected off surfaces in the room 3. The distance $r_A$ may be viewed as the propagation distance for the direct sounds while the distance $g_A$ may be viewed as the propagation distance for the reverberant sounds. In one embodiment, the direct sound energy $D_A$ may be calculated as $$\frac{1}{r^2}$$

while the reverberant sound energy $R_A$ may be calculated as $$\frac{100\pi T_{60}}{VDI},$$

where $T_{60}$ is the reverberation time in the room, V is the functional volume of the room, and DI is the directivity index of a sound pattern emitted by the speaker array 4 at the listener 2. In this example, since the direct sounds have a shorter distance to travel to the listener 2 than the reverberant sounds (i.e., shorter propagation distance), the direct sound energy level $D_A$ is greater than the reverberant sound energy level $R_A$.

As the listener 2 moves farther from the speaker array 4 to generate a larger propagation distance $r_B$ as shown in FIG. 4B, the direct sound energy $D_B$ has time to spread out before arriving at the listener 2. This increased propagation distance $r_B$ results in $D_B$ being noticeably less than $D_A$. In contrast, as the listener 2 moves farther from the speaker array 4 the propagation distance $g_B$ only slightly increases from the original distance $g_A$. This minor change in reverberant propagation distance results in a marginal decrease in reverberant energy from $R_A$ to $R_B$. The reverberant field as shown in FIGS. 4A and 4B is merely illustrative. In some embodiments, the reverberant field may be made up of hundreds of reflections such that when the listener 2 moves farther away from the speaker array 4 (e.g., the source) the listener 2 is moving farther from the first reflections (as shown in FIGS. 4A and 4B) but the listener 2 might actually be moving closer to other reflections (e.g., reflections off of the back wall) such that overall the reverberant energy is not noticeably affected by the listener 2's location in the room 3.

As can be seen in FIGS. 4A and 4B and described above, as the listener 2 moves away from the speaker array 4, the direct-to-reverberant energy ratio decreases since the propagation distance of the reflected sound waves only slightly increases while the propagation distance of the direct sound waves increases relatively more. To compensate for this ratio change, the directivity index DI of a sound pattern emitted by the speaker array 4 may be changed to maintain a constant ratio of direct-to-reverberant sound energy based on the distance r. For example, if a beam pattern generated by a speaker array is narrow and pointed at a listener, the direct-to-reverberant ratio will be large since the listener is receiving a large amount of direct energy and a comparatively smaller amount of reflected energy. Alternatively, if a beam pattern generated by the speaker array is wide, the direct-to-reverberant ratio is smaller as the listener is receiving comparatively more sound reflected off surfaces and objects. Altering the directivity index DI of a sound pattern emitted by the speaker array 4 may increase or decrease the amount of direct and reverberant sound emitted toward the listener 2. This change in direct and reverberant sound consequently alters the direct-to-reverberant energy ratio.

Figure 5:
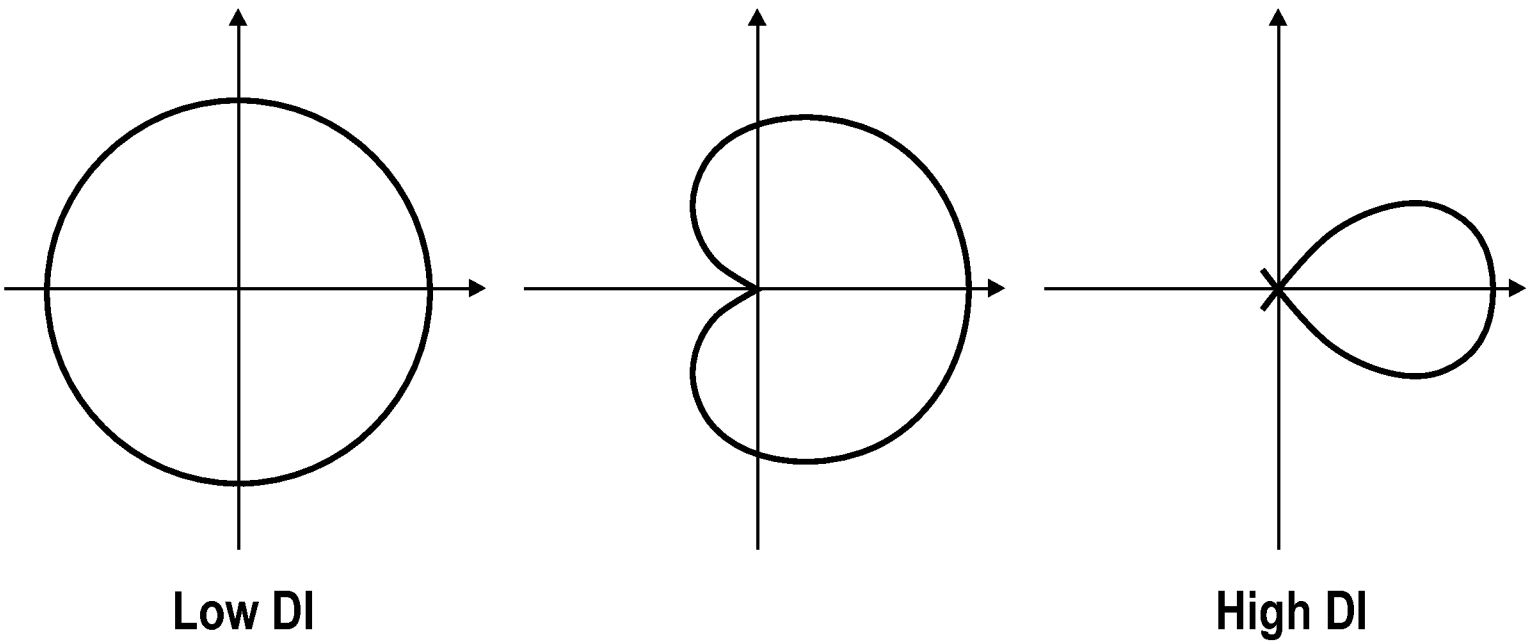
FIG. 5 shows an example set of sound patterns with different directivity indexes that may be generated by the speaker array.

As noted above, each of the transducers in the speaker array 4 may be separately driven according to different parameters and settings (including delays and energy levels). By independently driving each of the transducers 5, the directivity adjustment device 8 may produce a wide variety of directivity patterns with different directivity indexes DI to maintain a constant direct-to-reverberant energy ratio. FIG. 5 shows an example set of sound patterns with different directivity indexes. The leftmost pattern is omnidirectional and corresponds to a low directivity index DI, the middle pattern is slightly more directed at the listener 2 and corresponds to a larger directivity index DI, and the rightmost pattern is highly directed at the listener 2 and corresponds to the largest directivity index DI. The described set of sound patterns is purely illustrative and in other embodiments other sound patterns may be generated by the directivity adjustment device 8 and emitted by the speaker array 4.

In one embodiment, the directivity compensator 17 may calculate a directivity pattern with an associated directivity index DI that maintains a predefined direct-to-reverberant energy ratio. The predefined direct-to-reverberant energy ratio may be preset during manufacture of the directivity adjustment device 8. For example, a direct-to-reverberant energy ratio of 2:1 may be preset by a manufacturer or designer of the directivity adjustment device 8. In this example, the directivity compensator 17 calculates a directivity index DI that maintains the 2:1 ratio between direct-to-reverberant energy in view of the detected distance r between the listener 2 and the speaker array 4.

Upon calculation of a directivity index DI, the directivity compensator 17 feeds this value to the array processor 15. As noted above, the directivity compensator 17 may continually calculate directivity indexes DI for each channel of the sound program content played by the directivity adjustment device 8 as the listener 2 moves around the room 3. The audio channels output by the multiplexer 13 are processed by the array processor 15 to produce a set of audio signals that drive one or more of the transducers 5 to produce a beam pattern with the calculated directivity index DI. The processing may operate in both the time and frequency domains using transforms such as the Fast Fourier Transform (FFT).

In one embodiment, the array processor 15 decides which transducers 5 in the loudspeaker array 4 output one or more segments of audio based on the calculated directivity index DI received from the directivity compensator 17. In this embodiment, the array processor 15 may also determine delay and energy settings used to output the segments through the selected transducers 5. The selection and control of a set of transducers 5, delays, and energy levels allows the segment to be output according to the calculated directivity index DI that maintains the preset direct-to-reverberant energy ratio.

As shown in FIG. 3, the processed segment of the sound program content is passed from the array processor 15 to the one or more digital-to-analog converters 22 to produce one or more distinct analog signals. The analog signals produced by the digital-to-analog converters 22 are fed to the power amplifiers 23 to drive selected transducers 5 of the loudspeaker array 4.

In one example situation, the listener 2 may be seated on a couch across from a speaker array 4. The directivity adjustment device 8 may be playing an instrumental musical piece through the speaker array 4. In this situation, the directivity adjustment device 8 may seek to maintain a 1:1 direct-to-reverberant energy ratio. Upon commencement of the musical piece, the distance estimator 16 detects that the listener 2 is six feet from the speaker array 4 using the camera 20. To maintain a 1:1 direct-to-reverberant energy ratio based on this distance, the directivity compensator 17 calculates that the speaker array 4 must output a beam pattern with a directivity index DI of four decibels. The array processor 15 is fed the calculated directivity index DI and processes the musical piece to output a beam pattern of four decibels. Several minutes later, the distance estimator 16, with assistance from the camera 20, detects that the listener 2 is now seated four feet from the speaker array 4. In response, the directivity compensator 17 calculates that the speaker array 4 must output a beam pattern with a directivity index DI of two decibels to maintain a 1:1 direct-to-reverberant energy ratio. The array processor 15 is fed the updated directivity index and processes the musical piece to output a beam pattern of two decibels. After another several minutes has passed, the distance estimator 16, with assistance from the camera 20, detects that the listener 2 is now seated ten feet from the speaker array 4. In response, the directivity compensator 17 calculates that the speaker array 4 must output a beam pattern with a directivity index DI of eight decibels to maintain a 1:1 direct-to-reverberant energy ratio. The array processor 15 is fed the updated directivity index and processes the musical piece to output a beam pattern of eight decibels. As described in the above example situation, the directivity adjustment device 8 maintains the predefined direct-to-reverberant energy ratio regardless of the location of the listener 2 by adjusting the directivity index DI of a beam pattern emitted by the speaker array 4.

In one embodiment, different direct-to-reverberant energy ratios are preset in the directivity adjustment device 8 corresponding to the content of the audio played by the directivity adjustment device 8. For example, speech content in a movie may have a higher desired direct-to-reverberant energy ratio in comparison to background music in the movie. Below is an example table of content dependent direct-to-reverberant energy ratios.

| Content Type | Direct-to-Reverberant Energy Ratio |
|---|---|
| Foreground Dialogue/Speech | 4:1 |
| Background Dialogue/Speech | 3:1 |
| Sound Effects | 2:1 |
| Background Music | 1:1 |

The directivity compensator 17 may simultaneously calculate separate beam patterns with associated directivity indexes DI that maintain corresponding direct-to-reverberant ratio for segments of audio in separate streams or channels. For example, sound program content for a movie may have multiple streams or channels of audio. Each channel may include distinct features or types of audio. For instance, the movie may include five channels of audio corresponding to a front left channel, a front center channel, a front right channel, a rear right surround, and a rear left surround. In this example, the front center channel may contain foreground speech, the front left and right channels may contain background music, and the rear left and right surround channels may contain sound effects. Using the example direct-to-reverberant energy ratios shown in the above table, the directivity compensator 17 may maintain a direct-to-reverberant ratio of 4:1 for the front center channel, a 1:1 direct-to-reverberant ratio for the front left and right channels, and a 2:1 direct-to-reverberant ratio for the rear left and right surround channels. As described above, the direct-to-reverberant ratios would be maintained for each channel by calculating beam patterns with directivity indexes DI that compensate for the changing distance r of the listener 2 from the speaker array 4.

In one embodiment, the sound pressure P apparent to the listener 2 at a distance r from the speaker array 4 may be defined as:

$$P^2 = Q\left[\frac{1}{r^2} + \frac{100\pi T_{60}}{VDI}\right]$$

Where Q is the sound power level (e.g., volume) of a sound signal produced by the directivity adjustment device 8 to drive the speaker array 4, $T_{60}$ is the reverberation time in the room, V is the functional volume of the room, and DI is the directivity index of the sound pattern emitted by the speaker array 4. In one embodiment, the directivity adjustment device 8 maintains a constant sound pressure P as the distance r changes by adjusting the sound power level Q and/or the directivity index DI of a beam pattern emitted by the speaker array 4.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for driving a speaker array to output audio content to a listener, the method comprising:

detecting a distance of a listener from the speaker array;

computing a beam pattern directivity index for an audio channel based on (1) the detected distance of the listener from the speaker array and (2) a predefined direct-to-reverberant sound ratio;

determining a change in the detected distance of the listener from the speaker array;

responsive to determining the change in the detected distance, computing a new beam pattern directivity index that maintains the predefined direct-to-reverberant sound ratio at the listener; and playing the audio channel through the speaker array using the computed beam pattern directivity index.

2. The method of claim 1, wherein the predefined direct-to-reverberant sound ratio is variable based on the content of the audio channel.

3. The method of claim 1, wherein playing the audio channel using the computed beam pattern directivity index comprises: outputting one or more beam patterns based on the computed beam pattern directivity index.

4. The method of claim 3, wherein the beam pattern directivity index indicates the horizontal width of the one or more beam patterns.

5. The method of claim 4, wherein the width of the beam patterns increase as the distance between the listener and the speaker array decreases and the width of the beam patterns decrease as the distance between the listener and the speaker array increases.

6. The method of claim 1, wherein detecting the distance of the listener from the speaker array is performed by one of (1) a user input device; (2) a microphone; (3) an infrared sensor; and (4) a camera.

7. The method of claim 1, further comprising: adjusting the volume of the audio channel to maintain a constant sound pressure at the listener.

8. The method of claim 1 further comprising computing the direct-to-reverberant ratio based on $1/r^2$ as part of direct sound energy and $(100\pi T_{60})/(V*DI)$ as part of reverberant sound energy, wherein r is the distance between the listener and the speaker array, $T_{60}$ is a reverberation time in the room, V is a volume of the room, and DI is the beam pattern directivity index.

9. The method of claim 1, wherein the direct-to-reverberant sound ratio is predefined to be the same for at least two different distances of the listener from the speaker array.

10. A directivity adjustment device, comprising:

a distance estimator for detecting a distance between a listener and a speaker array, and then determining a change in the detected distance between the listener and the speaker array;

a directivity compensator for calculating a directivity index for a beam pattern emitted by the speaker array based on the detected distance and based on a direct-to-reverberant sound ratio, and responsive to the determined change in the detected distance computing a new beam pattern directivity index to hold the direct-to-reverberant sound ratio at a constant value; and an array processor for driving the speaker array to emit a beam pattern with the calculated directivity index for an audio channel.

11. The directivity adjustment device of claim 10, wherein the direct-to-reverberant sound ratio is variable based on the content of the audio channel.

12. The directivity adjustment device of claim 10, wherein the beam pattern directivity index indicates the horizontal width of the beam pattern.

13. The directivity adjustment device of claim 12, wherein the width of the beam pattern increases as the distance between the listener and the speaker array decreases and the width of the beam pattern decreases as the distance between the listener and the speaker array increases.

14. The directivity adjustment device of claim 10 further comprising one of (1) a user input device; (2) a microphone; (3) an infrared sensor; and (4) a camera to assist the distance estimator in detecting the distance between the listener and the speaker array.

15. The directivity adjustment device of claim 10, wherein the direct-to-reverberant sound ratio is predefined to be the same for at least two different distances between the listener and the speaker array.

16. An article of manufacture, comprising:

a non-transitory machine-readable storage medium that stores instructions which, when executed by a processor in a computer, cause the computer to:

determine a location of a listener in relation to a speaker array;

calculate a beam pattern directivity index for an audio channel based on the determined location of the listener in relation to the speaker array and based on a direct-to-reverberant sound ratio wherein the direct-to-reverberant ratio is variable based on content of the audio channel; and play the audio channel through the speaker array using the calculated beam pattern directivity index.

17. The article of manufacture of claim 16, wherein the instructions when executed by the processor determine a change in the location of the of the listener in relation to the speaker array, and responsive to the determined change in the location of listener compute a new beam pattern directivity index to hold the direct-to-reverberant sound ratio at a constant value.

18. The article of manufacture of claim 17, wherein the instructions to be executed by the processor to play the audio channel comprises: instructions to output one or more beam patterns based on the calculated beam pattern directivity index.

19. The article of manufacture of claim 18, wherein the beam pattern directivity index indicates the horizontal width of the one or more beam patterns.

20. The article of manufacture of claim 19, wherein the width of the beam patterns increase as the distance between the listener and the speaker array decreases and the width of the beam patterns decrease as the distance between the listener and the speaker array increases.

21. The article of manufacture of claim 16, wherein determining the location of the listener in relation to the speaker array is performed by one of (1) a user input device; (2) a microphone; (3) an infrared sensor; and (4) a camera.

22. The article of manufacture of claim 16, wherein the direct-to-reverberant sound ratio is predefined to be the same for at least two different locations of the listener in relation to the speaker array.

* * * * *